United States Patent [19]

Yamakawa et al.

[11] Patent Number: 4,818,973

[45] Date of Patent: Apr. 4, 1989

[54] SYSTEM FOR DETECTING A TRANSFER OF AN ARTICLE

[75] Inventors: Masami Yamakawa; Osamu Tomita, both of Yokohama, Japan

[73] Assignee: Kabushiki Kaisha Wako Sangyo, Japan

[21] Appl. No.: 72,888

[22] Filed: Jul. 14, 1987

[30] Foreign Application Priority Data

Aug. 1, 1986 [JP] Japan ..... 61-180062

[51] Int. Cl.[4] ..... G08B 13/24

[52] U.S. Cl. ..... 340/572; 340/527; 340/554

[58] Field of Search ..... 340/572, 554, 522

[56] References Cited

U.S. PATENT DOCUMENTS

| | | | |
|---|---|---|---|
| 3,713,133 | 1/1973 | Nathans | 340/572 |
| 3,859,652 | 1/1975 | Hall et al. | 340/572 |
| 3,891,980 | 6/1975 | Lewis et al. | 340/572 |
| 4,054,871 | 10/1977 | Terrell et al. | 340/554 |

*Primary Examiner*—Glen R. Swann, III

*Attorney, Agent, or Firm*—Kramer, Brufsky & Cifelli

[57] ABSTRACT

A system for detecting a transfer of article comprising a card attached to the article and a detector. When the article having the card is transferred to a monitoring area, electromagnetic signals are transmitted in advance from the detector to the monitoring area, and received by the card. Then, high frequency signals are transmitted from the card to the detector, thereby a transfer of the article can be detected.

6 Claims, 2 Drawing Sheets

5 TRANSMITTING ANTENNA

6 RECEIVING ANTENNA

11 LOW FREQUENCY OSCILLATION CIRCUIT

12 HIGH FREQUENCY OSCILLATION CIRCUIT

13 TRANSMITTING ANTENNA

5 TRANSMITTING ANTENNA
6 RECEIVING ANTENNA
11. LOW FREQUENCY OSCILLATION CIRCUIT
12 HIGH FREQUENCY OSCILLATION CIRCUIT
13 TRANSMITTING ANTENNA

SYSTEM FOR DETECTING A TRANSFER OF AN ARTICLE

BACKGROUND OF THE INVENTION

1. Field of the Invention

This invention relates to a system for detecting a transfer of article, and more particularly a very effective antitheft system for detecting any manual transfer of article(s) disposed on a display stand of a shop.

2. Description of the Prior Art

A conventional antitheft system for detecting any manual transfer of articles disposed on a display stand is proposed in Japanese Examined Patent Publication Ser. No. 52-30836 entitled "Process for monitoring articles and its apparatus" or Japanese Unexamined Patent Publication Ser. No. 60-51758 entitled "A card for the prevention of theft, and its manufacturing process".

According to such a conventional antitheft system, a card with a built-in high permeability magnetic substance is attached previously to a surface of respective articles, thereby signals for generating an alternating field such as microwaves are transmitted to a monitoring area. When transferring an article having the aforesaid card to the monitoring area, higher harmonic wave signals are secondarily transmitted from the built-in magnetic substance of the card by means of the aforesaid signals. Thus, by detecting the higher harmonic wave signals, it is possible to detect a transfer of article to a non-monitoring area, thereby the articles on the display stand can be prevented from being stolen.

However, such conventional detecting system has the following disadvantages and inconveniences in view of performance and shape.

(1) When a certain metal body having a property similar to the magnetic substance of the card is transferred to the monitoring area, the card often malfunctions.

(2) When the card is closely attached to a human body, signal transmission is prevented so that the sensor of the detecting system is inoperative.

(3) If the card is removed from the article before the latter passes out of the monitoring area, it becomes impossible to detect a transfer of such article.

(4) In order to actuate the card stably, it requires a considerably larger size. Accordingly, it is entirely impossible to attach such a large card to respective precious and small articles such as watches, jewels, precious metals or the like.

(5) Even if the detecting system is actuated normally, it becomes difficult to detect any person holding the article with such card from among many people when he or she is lost in the crowd.

In view of the above points, this invention has been achieved.

BRIEF SUMMARY OF THE INVENTION

It is therefore a general object of this invention to provide a system for detecting a transfer of article, in which a card to be attached to respective article can be small-sized and detection can be carried out accurately.

More specifically, the system for detecting a transfer of article comprises a card attached to the article and a detector, in which when the article having the card is transferred to a monitoring area, electromagnetic signals are transmitted in advance from the detector to the monitoring area, and received by the card.

Then, high frequency signals are transmitted from the card to the detector, thereby a transfer of the article can be detected.

Further, the system for detecting a transfer of article comprises a sensor for sensing a person's access to a monitoring area without touching the person, an electromagnetic wave generating circuit for transmitting electromagnetic wave signals from the sensor, and a power source circuit.

Other and further objects and features of this invention will appear more fully from the following description with reference to the accompanying drawings.

BRIEF DESCRIPTION OF THE ACCOMPANYING DRAWINGS

DETAILED DESCRIPTION OF PREFERRED EMBODIMENT

A preferred embodiment of this invention will now be described with reference to the accompanying drawings.

Figure 1:
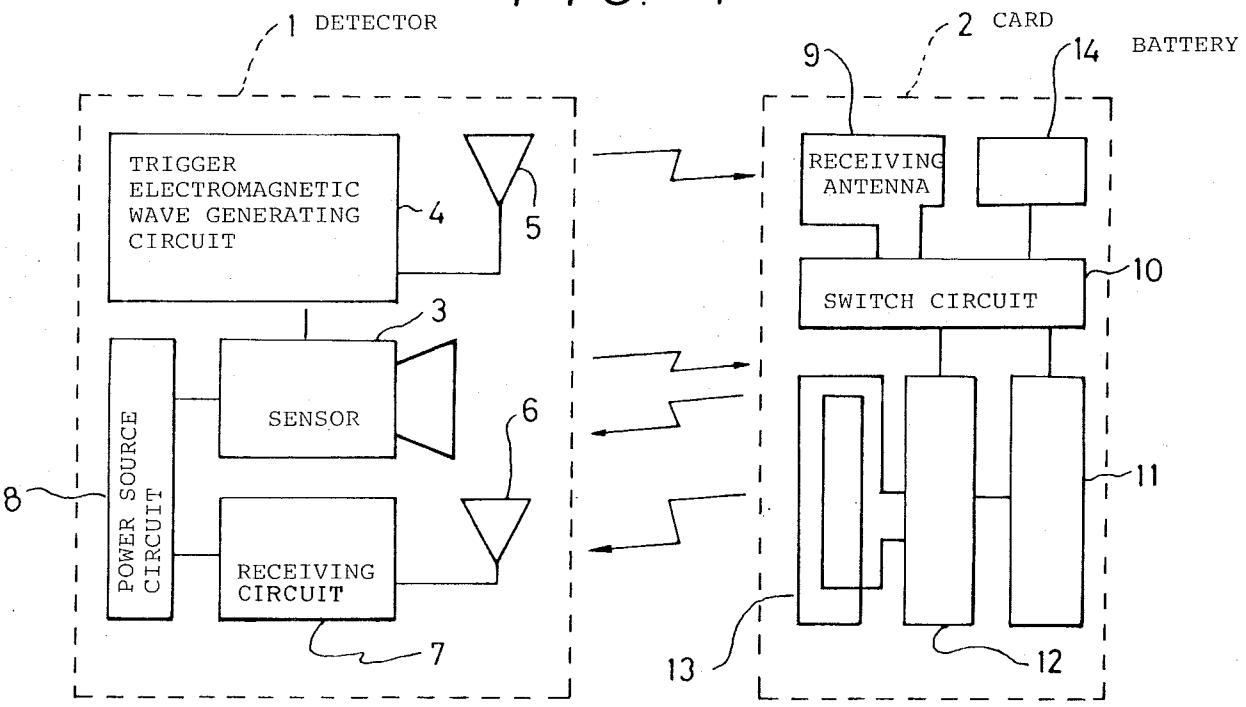
FIG. 1 is a block diagram of a system for detecting a transfer of article according to this invention.

FIG. 1 is a block diagram showing a basic circuit structure of a detecting system according to this invention.

The detecting system is composed of a detector 1 and a card 2 which is attached to respective articles disposed within a monitoring area.

The detector 1 includes a sensor 3 for sensing a person's entrance into the aforesaid monitoring area without touching the person, a trigger electromagnetic wave generating circuit 4 for transmitting electromagnetic signals to the monitoring area by means of signals from the sensor 3, a transmitting antenna 5 of the trigger electromagnetic wave generating circuit 4, a receiving antenna 6 for receiving high frequency signals from the card 2, a receiving circuit 7, and a power source circuit 8 for the sensor 3 and the receiving circuit 7.

The card 2 includes a receiving antenna 9 for receiving electromagnetic signals transmitted from the trigger electromagnetic wave generating circuit 4, a switch circuit 10 operable upon receipt of the electromagnetic signals, a low frequency oscillation circuit 11 for outputting low frequency signals by the operation of the switch circuit 10 a high frequency oscillation circuit 12 for transmitting high frequency signals toward the detector 1, an antenna 13 for transmitting the high frequency signals, and a power source battery means 14 for those components.

Figure 2:
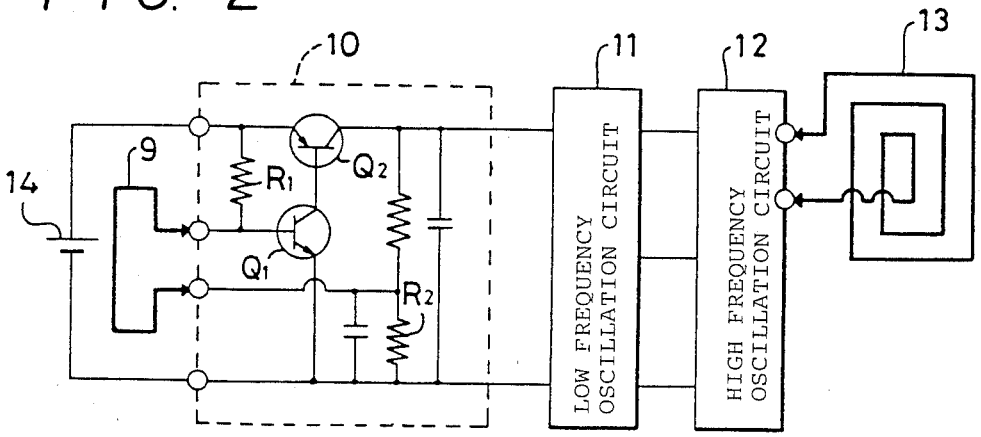
FIG. 2 is a circuit diagram of a main part of the block diagram in FIG. 1.

FIG. 2 shows a circuit diagram of a main part of the card 2, in which the receiving antenna 9 is of a loop shape and mounted removably thereon. At a normal time (i.e. in case of a non-receipt of signals), the electric current from the battery 14 flows through the receiving antenna 9 and a resistor $R_2$ from a resistor $R_1$, so that a transistor $Q_1$ is off and a transistor $Q_2$ is also off. Thus, the switch circuit 10 is not operable.

To minimize the consumption of the battery 14, the value of the resistor $R_1$ is large. In this embodiment, the resistor $R_1$ is set at about 4 MΩ, while the resistor $R_2$ is set at about 300 KΩ.

When the receiving antenna 9 receives the electromagnetic wave signals from the detector 1, the transistor $Q_1$ is on by receipt of a base current and the transistor $Q_2$ is also on. Thus, the switch circuit 10 is operable.

Since the receiving antenna 9 of the card 2 is made of a loop-shaped flexible lead wire, it is hung as a hanging string on respective articles disposed on the display stand. Accordingly, it is something like a price tag.

When a person enters into the monitoring area where the articles having the card 2 are disposed on the display stand, the detector 1 senses the person's entrance to the sensor 3, and is actuated. Then, the electromagnetic wave signals from the trigger electromagnetic wave generating circuit 4 is immediately transmitted toward the monitoring area.

At that time, if any person located within the monitoring area holds any article attached by the card 2, the electronic circuit of the card 2 is actuated, thereby the high frequency signals modulated with a certain frequency are transmitted. Thus, when such high frequency signals are received by the receiving circuit 7 of the detector 1, the detector 1 is able to detect the presence of the card 2, i.e. the article attached thereto.

The card 2 is small in size and can be attached to a small area of respective articles, Further, it can be removed simply in exchange for the money. Further, when removing the receiving antenna 9 as a hanging string, the switch circuit 10 can be operated, thereby a transfer of respective article can be detected. Accordingly, it becomes much easier to discover shoplifting in the shops and prevent the displayed articles from being stolen.

Figure 3:
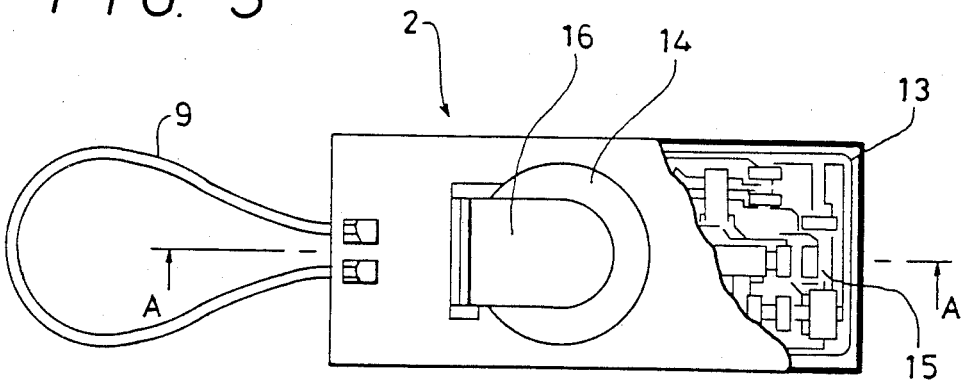
FIG. 3 is a partially cutaway plan view of a card to be used in this invention.
Figure 4:
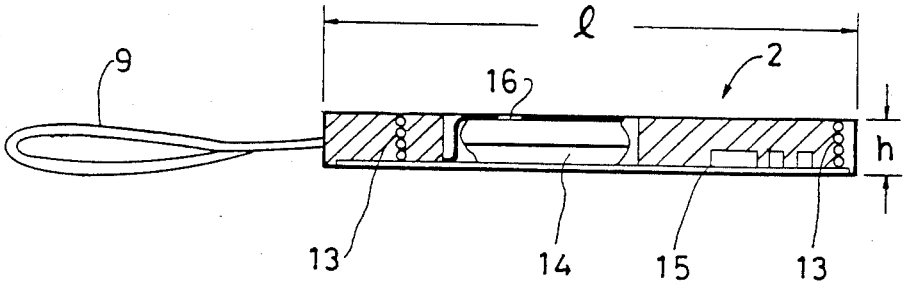
FIG. 4 is a section view taken on line A—A of FIG. 3.

The structure of the card 2 will now be described with reference to FIGS. 3 and 4.

Each electronic circuit described above is disposed on a circuit substrate 15 of the card 2, and the battery 14 is secured by a support plate 16. The length l and thickness h of the card 2 are a few centimeters (cm) and a few milimeters (mm) respectively, so that it may be attached to such expensive small articles as jewels, precious metals or the like. Therefore, the detecting system according to this invention is very suitable for the prevention of theft or shoplifting.

The signal receiving and transmitting between the detector 1 and the card 2 will now be referred to in detail.

The sensor 3 of the detector 1 is actuated on the basis of the Doppler effect that the frequency of the reflective waves reflected by the impact of the transmitted microwaves upon an object (e.g. a human body) is increased more than, or decreased less than, that of the transmitted microwaves. Through the detection of the Doppler radar, the sensor 1 is able to sense any person's access to the monitoring area without touching the person.

More specifically, the microwave signals of e.g. 10,525 GHz is constantly in advance transmitted toward the monitoring area. Thus, when any person enters the monitoring area, the reflective waves of the frequency increase in proportion to his or her access speed and are received by the detector 1. Thus, a difference i.e. Doppler frequency, between the frequency of the transmitted microwave and that of the reflective waves is detected by means of the Heterodyne system, and then amplified to actuate a built-in electromagnetic relay (not illustrated).

The Doppler frequency is about 40 Hz to 180 Hz for the frequency of the aforesaid microwaves. When the built-in electromagnetic relay is on, the trigger electromagnetic wave generating circuit 4 is actuated, and the electromagnetic wave signals (pulse signals) are transmitted from the transmitting antenna 5 to the monitoring area.

Since the transmitting antenna 5 of the detector 1 is small-sized, it is desirable to increase the frequency of the electromagnetic wave signals, However, when the frequency is too high, the electromagnetic wave signals are intercepted by a human body, so that they cannot reach the card 2. Preferably, the frequency of the electromagnetic wave signals is about 400 MHz, no more than 1 GHz. In case the transmitting antenna 5 is a ferrite bar antenna, in which a wire is wound on the ferrite bar, it is possible to select the electromagnetic wave signals having a lower frequency of 100 KHz to 300 KHz.

When the electromagnetic wave signals are transmitted through the transmitting antenna 5, the card 2 located within the monitoring area is actuated. As described previously, the receiving antenna 9 of the card 2 receives the electromagnetic wave signals, thereby the switch circuit 10 is turned on. Then, an electric voltage from the built-in battery 14 is applied for the low frequency oscillation circuit 11 and the high frequency oscillation circuit 12, and both circuits 11, 12 are operated.

Then, the high frequency oscillation circuit 12 is modulated by about 3 KHz low frequency provided by the low frequency oscillation circuit 11, and oscillates about 75 MHz high frequency. The high frequency signals consisting of about 3 KHz modulated frequency and about 75 MHz carrier frequency are transmitted through the transmitting antenna 13. As long as the built-in battery 14 is actuated, the high frequency signals are generated.

If the switch circuit 10 will be provided with a time limit element (not illustrated), it may be turned off automatically after the lapse of a certain time.

The high frequency signals transmitted by the transmitting antenna 13 of the card 2 are received by the receiving circuit 7 of the detector 1 and introduced into the receiving circuit 7. In the receiving circuit 7, processing such as high frequency amplifying, detection, low frequency amplifying, etc., are carried out, in which about 3 KHz low frequency signals are amplified selectively, so that the electromagnetic relay is actuated by a Schmidt trigger circuit (not illustrated) to operate an alarm means.

As discussed above, the receiving antenna of the card is formed in a loop shape and removably attached to the card. Further, in the case the receiving antenna is removed from the card, the switch circuit of the card can be actuated. Since the card can be small-sized, it can be attached to respective small-sized articles.

It is further understood by those skilled in the art that the foregoing description is a preferred embodiment of the disclosed system and that various changes and modifications may be made in the invention without departing from the spirit and scope thereof.

What is claimed is:

1. A system for detecting a transfer of an article through a monitoring area, said system comprising:

a detector including sensor means for sensing, based on the Doppler effect, an object moving through said monitoring area, said sensor being active before said object reaches said monitoring area and while said object is in said monitoring area to scan for said object; and first transmitter means, coupled to the sensor means, for transmitting a first electromagnetic signal toward said monitoring area when said sensor means senses said object moving through said monitoring area; and a circuit card for attachment to an article carried by said object, said circuit card comprising a battery; second transmitter means powered by said battery for generating and transmitting a second electromagnetic signal when activated; and first receiver means for receiving said first electromagnetic signal and activating said second transmitter means when said first receiver means receives said first electromagnetic signal;

wherein said detector further comprises second receiver means for receiving said second electromagnetic signal and activating an alarm in response to reception of said second electromagnetic signal;

wherein said first receiver means comprises an antenna; and transistor means having a base coupled to said antenna for activating said second transmitter means upon receipt of said first electromagnetic signal by said antenna;

wherein said second transmitter comprises oscillator means, coupled to an output of said transistor, for generating said second electromagnetic signal upon activation of said transistor; and wherein said battery has a first terminal coupled to said base of said transistor means to deliver battery current toward said base, said antenna is releasably attached to said card with one end coupled to said base of said transistor means and another end coupled to a second terminal of said battery such that when said antenna is attached, said antenna shunts said battery current away from said base of said transistor means, and when said antenna is removed from said card, said battery current flows from said power supply into said base thereby activating said transistor means and in turn said second transmitter means.

2. A system as set forth in claim 1 wherein said antenna forms a loop between its ends and protrudes from said card, and the releasable attachment of said antenna to said card permits insertion of said antenna through an aperture in said article to attach said card to said article.

3. A system as set forth in claim 1 wherein said second electromagnetic signal comprises a first frequency outside of the audible range, which first frequency is modulated by a second frequency within the audible range to activate said alarm.

4. A system as set forth in claim 1 wherein said sensor means comprises:

third transmitter means for transmitting a microwave signal toward said monitoring area; and third receiver means for receiving reflections of said microwave signal from said moving object, and detecting a difference in frequency between the transmitted microwave signal and the reflected microwave signal corresponding to the velocity of said moving object.

5. A system as set forth in claim 4 wherein a fundamental frequency of said microwave signal is several times larger than a fundamental frequency of said first electromagnetic signal.

6. A system as set forth in claim 5 wherein said fundamental frequency of said microwave signal is several times larger than that to which said first receiver means can respond.

* * * * *